US010468758B1

(12) United States Patent
Ozdemir et al.

(10) Patent No.: US 10,468,758 B1
(45) Date of Patent: Nov. 5, 2019

(54) ZERO WEIGHT AIRBORNE ANTENNA WITH NEAR PERFECT RADIATION EFFICIENCY UTILIZING CONDUCTIVE AIRFRAME ELEMENTS AND METHOD

(71) Applicant: Virtual EM Inc., Ann Arbor, MI (US)

(72) Inventors: Tayfun Ozdemir, Ann Arbor, MI (US); Christopher N. Davis, Ann Arbor, MI (US)

(73) Assignee: VIRTUAL EM INC., Ann Arbor, MI (US)

( * ) Notice: Subject to any disclaimer, the term of this patent is extended or adjusted under 35 U.S.C. 154(b) by 0 days.

(21) Appl. No.: 15/973,448

(22) Filed: May 7, 2018

(51) Int. Cl.

| | |
|---|---|
| ***H01Q 1/28*** | (2006.01) |
| ***H01Q 9/40*** | (2006.01) |
| ***H01Q 9/28*** | (2006.01) |
| ***H01Q 1/52*** | (2006.01) |

(52) U.S. Cl.
CPC ..... *H01Q 1/28* (2013.01); *H01Q 1/521* (2013.01); *H01Q 9/28* (2013.01); *H01Q 9/40* (2013.01)

(58) Field of Classification Search
CPC ..... H01Q 1/28; H01Q 1/521; H01Q 9/28; H01Q 9/40
USPC ..... 343/702
See application file for complete search history.

(56) References Cited

U.S. PATENT DOCUMENTS

| | | | |
|---|---|---|---|
| 2,510,696 | A | 6/1950 | Johnson |
| 3,365,721 | A | 1/1968 | Bittner |
| 3,564,134 | A | 2/1971 | Rue |
| 3,587,102 | A | 6/1971 | Czerwinski |
| 3,646,562 | A | 2/1972 | Acker et al. |
| 3,742,495 | A | 6/1973 | Diamantides |
| 4,100,546 | A | 7/1978 | Campbell et al. |
| 4,117,490 | A | 9/1978 | Arnold et al. |
| 5,231,409 | A | 7/1993 | Astier et al. |
| 6,119,976 | A | 9/2000 | Rogers |
| 7,053,812 | B2 | 5/2006 | Trainor |
| 7,467,762 | B1 | 12/2008 | Parsons |
| 8,115,145 | B2 | 2/2012 | Shariff et al. |
| 8,282,040 | B1 | 10/2012 | Westman et al. |
| 9,337,889 | B1 | 5/2016 | Stapleford |
| 2008/0210818 | A1 | 9/2008 | Chiu et al. |
| 2009/0322147 | A1 | 12/2009 | Cooney |
| 2015/0236778 | A1 | 8/2015 | Jalali |
| 2015/0237569 | A1 | 8/2015 | Jalali |

*Primary Examiner* — Graham P Smith

(74) *Attorney, Agent, or Firm* — J. Gordon Lewis

(57) ABSTRACT

An aircraft includes a fuselage assembly including a first elongated structural member formed of electrically conductive material, at least one wing assembly including a second structural member formed of electrically conductive material, at least one horizontal stabilizer assembly including a third structural member formed of electrically conductive material, and at least one vertical stabilizer assembly including a fourth structural member formed of electrically conductive material. The wing assembly, the horizontal stabilizer, and the vertical stabilizer are each interconnected with the fuselage assembly in a flight configuration normal to the fuselage. The first, second, third and fourth structural members are electrically insulated from one another. An electronic communication device within the aircraft is configurable for selective electrical interconnection of two or more of said structural members to form a dipole or monopole type transmitting/receiving antenna.

19 Claims, 13 Drawing Sheets

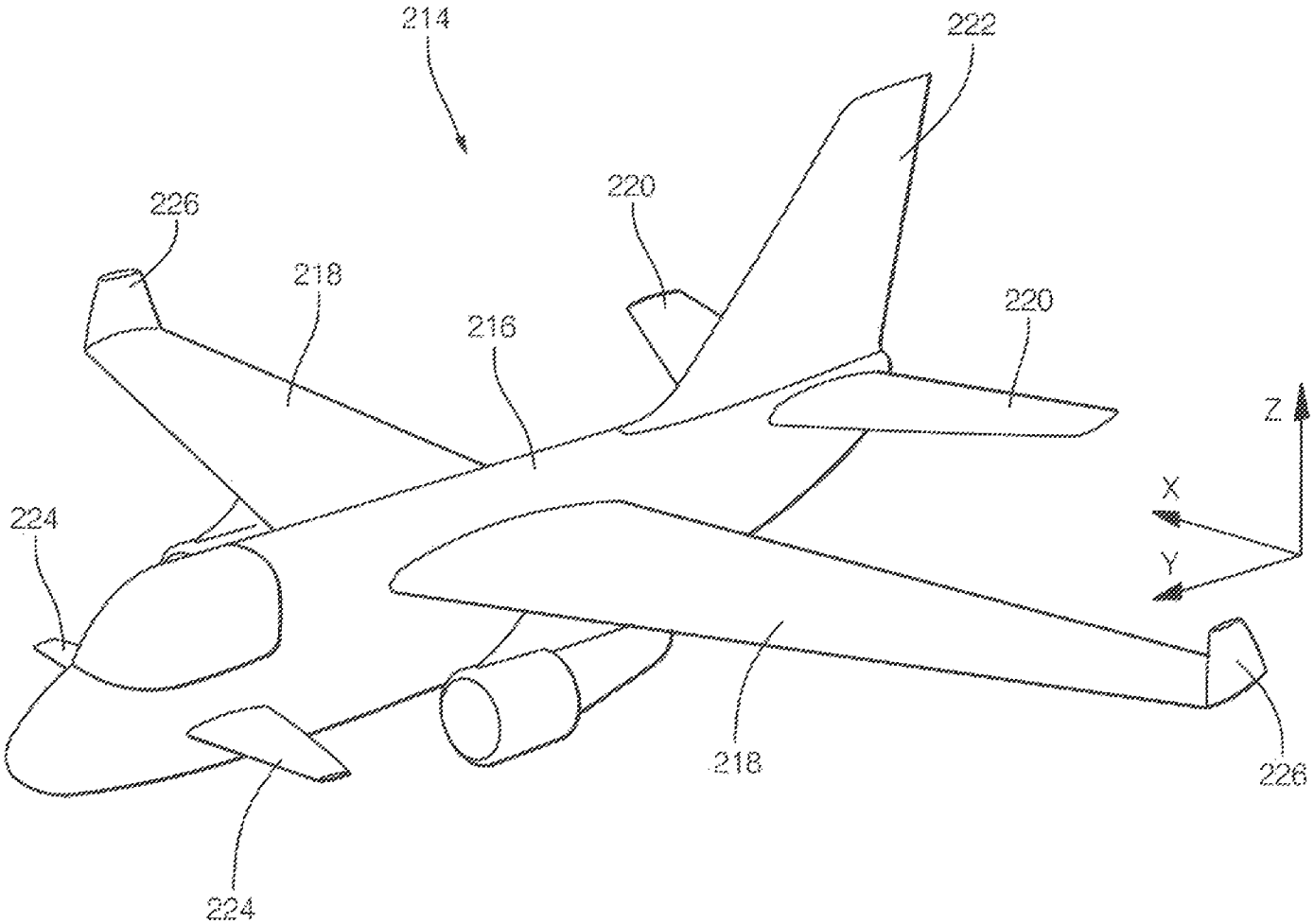
FIG. 0.1

| DESCRIPTION | WIRING TOPOLOGY | POLARIZATION |
|---|---|---|
| WING DIPOLE | 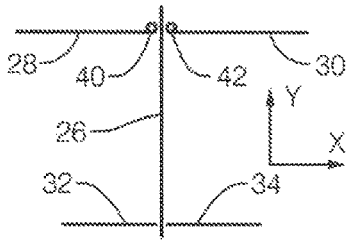 | X |
| HORIZONTAL STABILIZER DIPOLE | 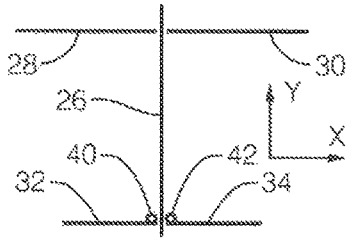 | X |
| VERTICAL STABILIZER MONOPOLE | 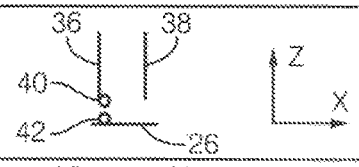 | Z |
| VERTICAL STABILIZER MONOPOLE ARRAY | 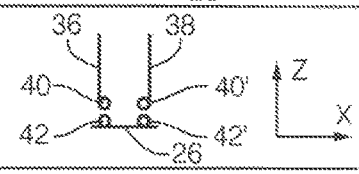 | Z |
| FUSELAGE MONOPOLE WITH WINGS (CONNECTION POINT FOR WINGS CAN BE EITHER LEFT OR RIGHT WING, DIAGRAM SHOWS RIGHT WING) | 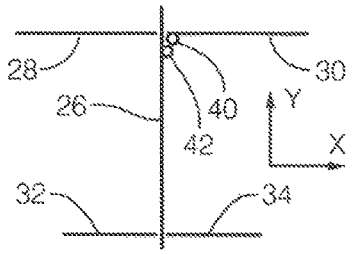 | Y |
| FUSELAGE MONOPOLE WITH HORIZONTAL STABILIZERS (CONNECTION POINT FOR HORIZONTAL STABILIZER CAN BE EITHER LEFT OR RIGHT STABILIZER, DIAGRAM SHOWS RIGHT STABILIZER) | 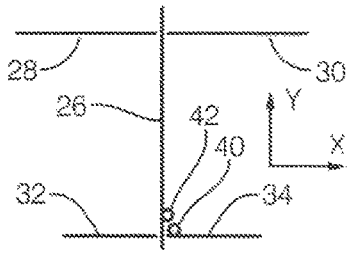 | Y |

FIG. 2

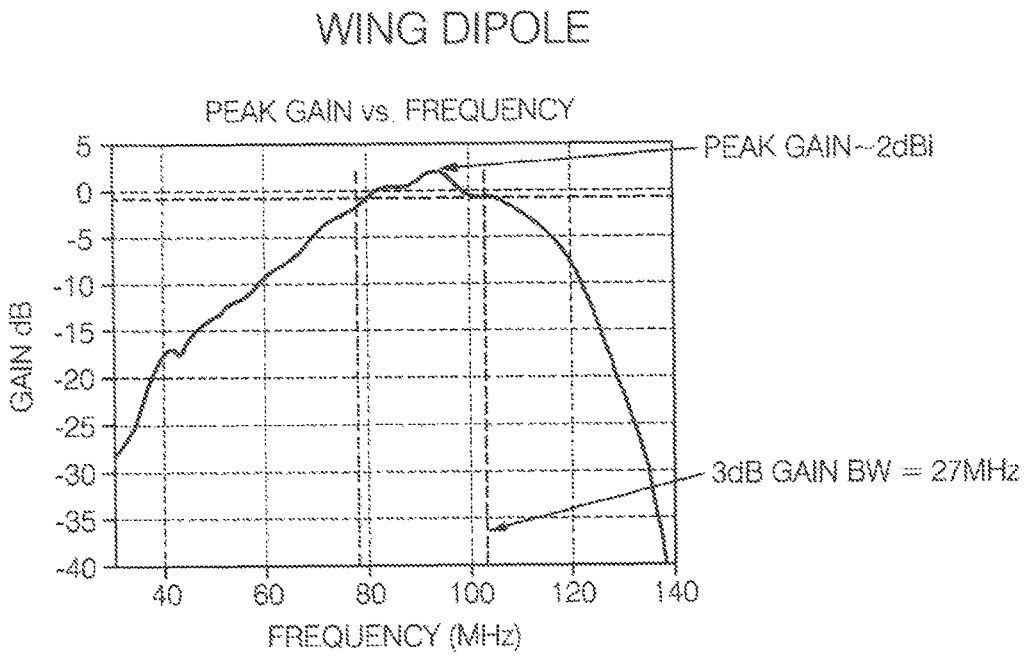
FIG 5A1
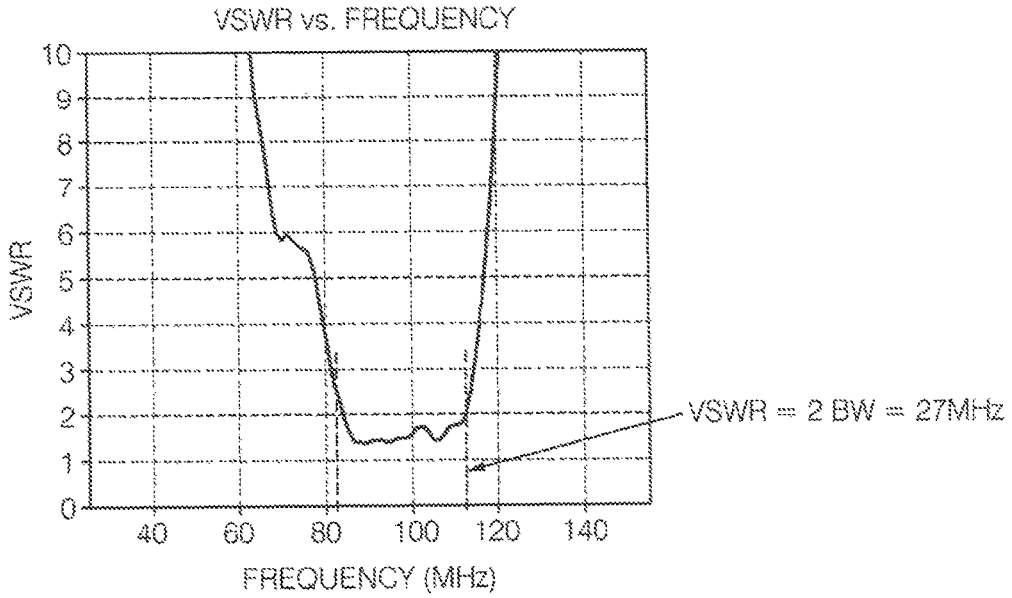
FIG 5A2

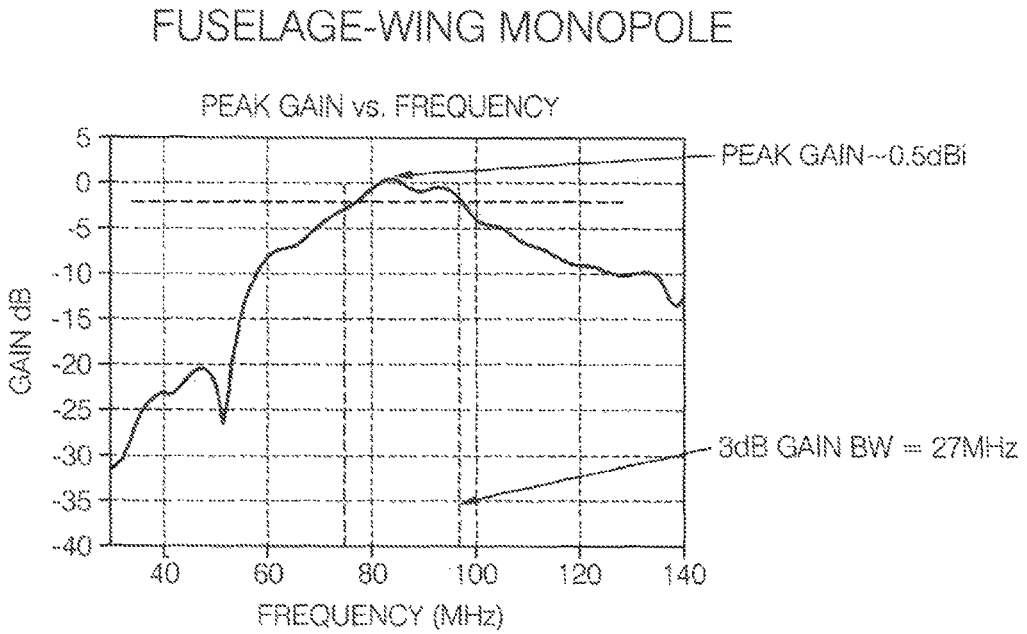
FIG 5B1
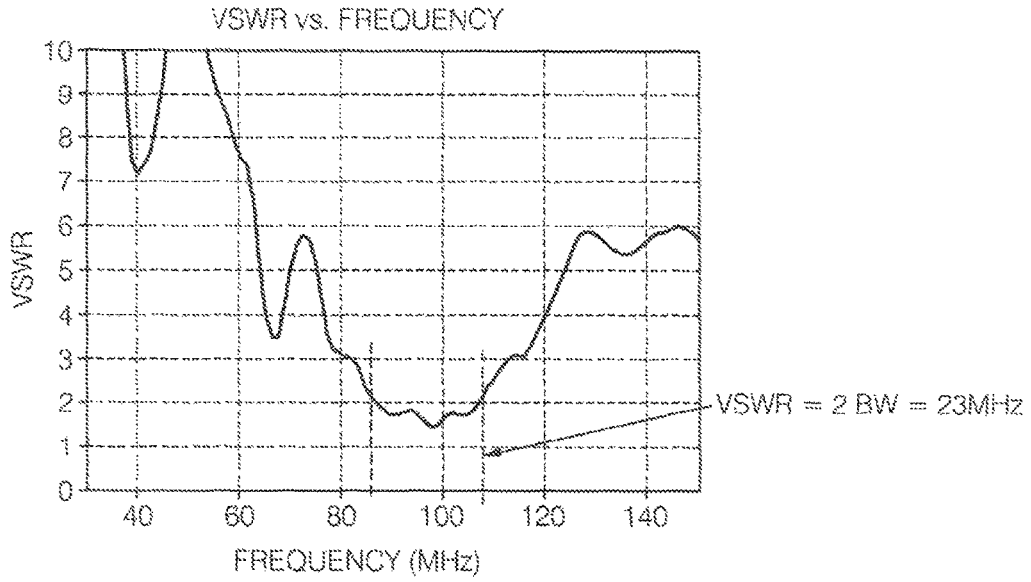
FIG 5B2

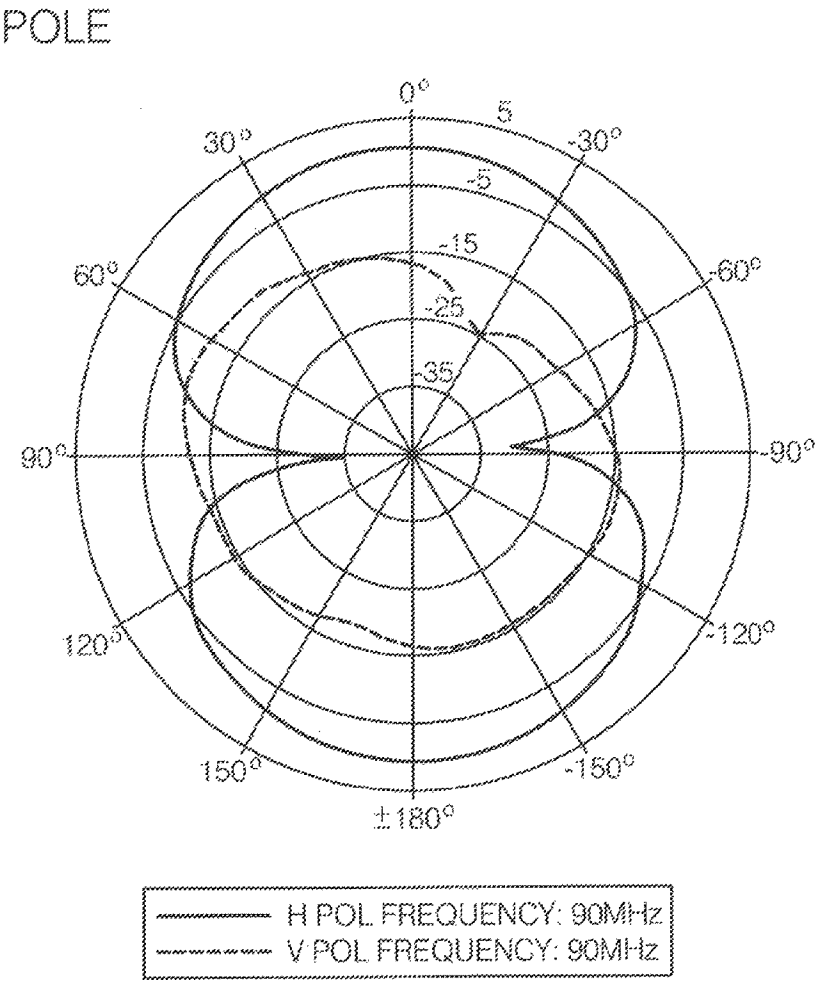
FIG. 6A2
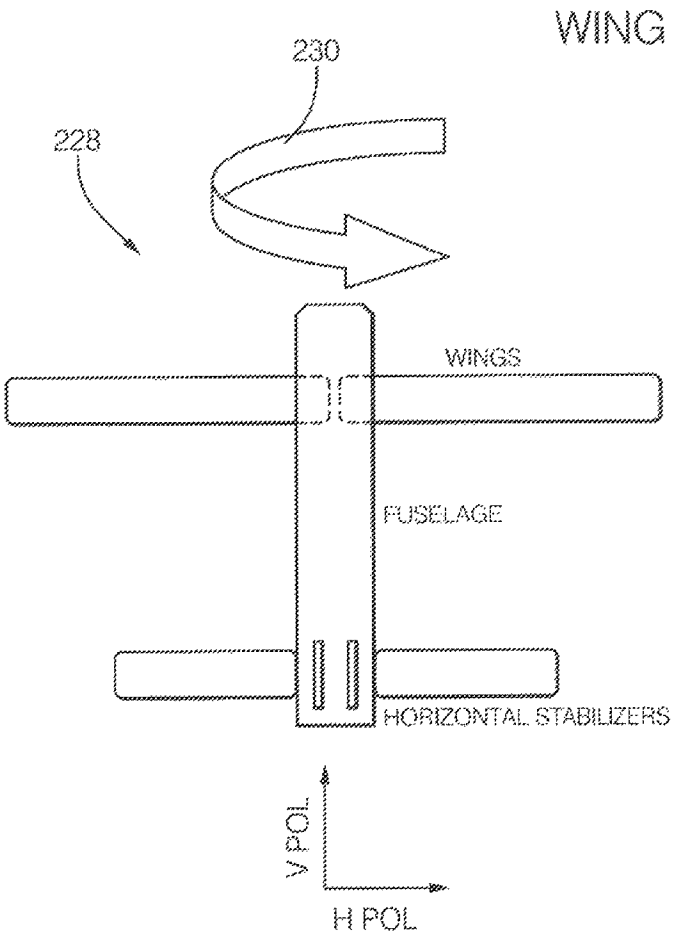
FIG. 6A1

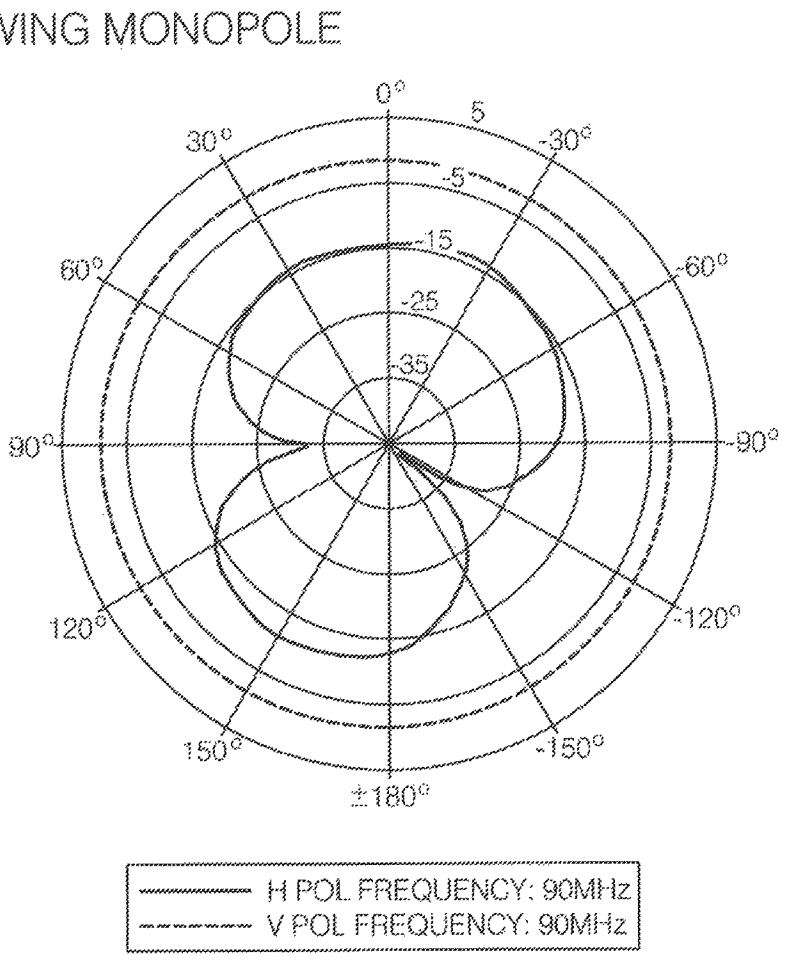
FIG. 6B2
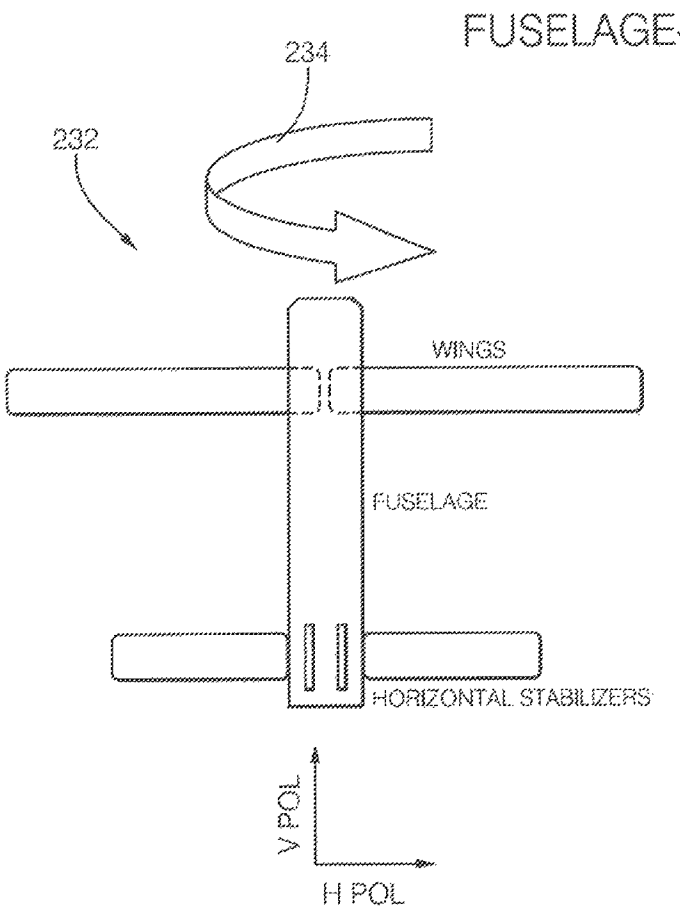
FIG. 6B1

ZERO WEIGHT AIRBORNE ANTENNA WITH NEAR PERFECT RADIATION EFFICIENCY UTILIZING CONDUCTIVE AIRFRAME ELEMENTS AND METHOD

GOVERNMENT RIGHTS STATEMENT

The government has rights to this invention pursuant to Contract No. N00014-14-C-0076 awarded by the U.S. Department of Defense (Office of Naval Research) entitled "Efficient HF Transmit Antennas Utilizing Platform Coupling and Reconfigurable Aperture".

TECHNICAL FIELD

The present invention is related to aircraft antenna systems, and more particularly, the incorporation of such antenna systems within a host airframe, and more particularly still, the incorporation of such antenna systems within field launched drones and unmanned aerial vehicles.

BACKGROUND OF THE INVENTION

The integration of wide-band high efficiency antennas into airframes especially at low frequencies is very difficult for two reasons: (1.) such antenna need to be large and cannot be protruding out of the airframe, and (2.) because most airframes are electrically conductive (aluminum or carbon-fiber), a conformational antenna printed on such surfaces have narrow bandwidth and low efficiency.

A search of issued U.S. patents in the field of aircraft antennas and related apparatus reveals U.S. patents related generally to the field of the present invention but which do not anticipate nor disclose the device of the present invention. The discovered U.S. patents relating generally to the present invention are discussed herein below.

U.S. Pat. No. 4,100,546 to Campbell et al. entitled "Airborne Antenna System Employing the Airframe as an Antenna" and U.S. Pat. No. 4,117,490 to Arnold et al. entitled "Inconspicuous Antenna System Employing the Airframe as an Antenna" each disclose a phase front homing system airborne antenna array employing portions of the airframe as two antenna elements. The invention provides an improved phase homing system antenna wherein the antenna elements are concealed or greatly reduced in profile. The antenna system comprises two substantially vertical sections of the airframe of the airplane. Included also are respective metallic toroid coils encompassing each of the vertical airframe sections and electromagnetically coupled thereto. The combination of each vertical section and its associated toroid coil comprises a respective antenna and corresponding terminals of the toroid coils comprise the radio frequency feed terminals to the respective antennas. The phase front homing system derives the desired sense of direction to a prescribed beacon transmitter by utilizing directly the phase difference at the two antenna elements.

U.S. Pat. No. 3,587,102 to Czerwinski entitled "Helicopter Skid Antenna" discloses a system of struts which are disposed perpendicular to the roll axis of a helicopter for supporting the landing skids thereof and are insulated from the helicopter fuselage. One of the struts has an antenna feed at its center, thereby the entire landing gear assembly functions as a folded dipole antenna or a loop antenna, depending on the operating frequency.

U.S. Pat. No. 2,510,698 to Johnson entitled "Radio Aerial, Particularly for Aircraft and Other Vehicles", discloses an antenna design suitable for modern high speed aircraft, inter alia, wherein structural difficulties arise in fitting conventional (mast or wire) aerials external of the airframe. A mast type of aerial in the form of a wire stretched between two suitable external points of the host aircraft is subject to large aerodynamic forces such that it either becomes torn away from its supports, or due to its mechanical drag seriously interferes with the aerodynamic performance of the aircraft, besides being liable to a form of electrical interference known as precipitation static, as well as being a source of danger to the aircraft due to the possibility of fracture when flying at very high speeds approaching the speed of sound. Johnson provides a simple and unobtrusive radio aerial employing the metallic surface of the airframe structure to which it is applied and inductively couples the metallic surface to radio transmitting or receiving equipment whereby the surface is excited by the inductive coupling to effect radiation when radio signals are being transmitted or the inductive coupling is excited by the currents induced in the surface by electromagnetic radiations of a received radio signal. The inductive coupling may comprise one or more toroidal windings of wire which may either surround the metallic surface with the plane of the toroid or coil perpendicular to the axis of the surface or it may be concentrated at one or more points adjacent the metallic surface. In one application, the inductive coupling is mounted adjacent to the wing root, but external to the metal fuselage of the aircraft, whereby it sets up a magnetic field encircling the wing root or a portion thereof. One feature of the invention resides in associating the inductive coupling with two metallic structural parts whose longitudinal axes are mutually inclined so that the two parts act as crossed dipoles. When this feature is applied to an aircraft, the metallic wing and fuselage, or metallic portions of the fuselage and wing have an appropriate induction coil mounted adjacent to them in a manner which gives the required polar diagram of magnetic field.

None of the above listed U.S. patents disclose or suggest a zero weight antenna for aircraft utilizing conductive aircraft elements and method of the present invention. U.S. Pat. No. 4,100,546 to Campbell et al. and U.S. Pat. No. 4,117,490 to Arnold et al. describe an antenna realized by exciting the landing gear of a fixed-wing aircraft via inductive coupling. Neither Campbell nor Arnold reveal that the landing gears are electrically isolated from the aircraft body and biased against each other, which would be relevant to the present invention. Instead, both Campbell and Arnold claim to generate monopoles via inductive coupling. Similarly, U.S. Pat. No. 3,587,102 to Czerwinski describes a loop antenna realized by exciting the landing gear of a helicopter via direct electrical contact when the landing gear is electrically isolated from the body of the aircraft and via inductive coupling in the absence of electrical isolation. Czerwinski does not reveal that the body of the aircraft is biased against the landing gear to generate an antenna, which would be relevant to the present invention. U.S. Pat. No. 2,510,698 to Johnson proposes excitation of sections of the aircraft's airframe via inductive coupling at multiple locations to facilitate radiation and reception of radio waves. Johnson does not propose to isolate sections of the airframe from each other electrically and bias them against each other to form dipoles and monopoles, which is the essence of the present invention. Each of the above listed U.S. patents and published applications (i.e., U.S. Pat. Nos. 4,100,546, 4,117,490; 3,587,102; and 2,510,698) are hereby incorporated herein by reference.

SUMMARY OF THE INVENTION

The forgoing problems and limitations are overcome and other advantages are provided by new and improved conformal and zero net weight wide-band high efficiency antennas incorporated within airframes.

Therefore, it is an object of the present invention to provide a zero net weight antenna for aircraft employing pre-existing conductive airframe elements.

The present invention provides an aircraft with a fuselage assembly including a first elongated structural member formed of electrically conductive material and at least one airfoil assembly including a second structural member formed of electrically conductive material. The airfoil is interconnected with the fuselage assembly in a flight configuration wherein the first and second structural members are electrically insulated from one another. Airfoil assembly may have opposed pair of symmetric sections including an apposed pair of said second structural members electrically isolated from each other and from the fuselage. An electronic communication device disposed within said aircraft is configurable for selective electrical interconnection of said first and second structural members or for selective electrical interconnection of the pair of second structural members to form a transmitting/receiving antenna.

According to one aspect of the invention, the airfoil consists of a concentric opposed pair of main wings including an aligned pair of said second structural members, and wherein the electronic communication device is operable for selective electrical interconnection of the pair of second structural members to form a wing dipole antenna.

According to another aspect of the invention, the electronic communication device is operable for selective electrical interconnection of the first structural member with one of the pair of second structural members to form a fuselage-wing monopole antenna.

According to yet another aspect of the invention, the airfoil comprises a concentric opposed pair of horizontal stabilizers including an aligned pair of second structural members. The electronic communication device is operable for selective electrical interconnection of the pair of second structural members to form a horizontal stabilizer dipole antenna.

According to yet another aspect of the invention, the electronic communication device is operable for selective electrical interconnection of the first structural member with one of the pair of second structural members to form a fuselage-horizontal stabilizer monopole antenna.

According to yet another aspect of the invention, the electronic communication device is operable for selective electrical interconnection of the first structural member with the second structural member to form a vertical stabilizer monopole antenna.

According to yet another aspect invention, the electronic communication device is operable for selective electrical interconnection of the first structural member with each of the second structural members to form a vertical stabilizer monopole antenna array.

According to yet another aspect of the invention, the aircraft includes a fuselage assembly including an elongated structural member formed of electrically conductive material, at least one wing assembly including a second structural member formed of electrically conductive material, at least one horizontal stabilizer assembly including a third structural member formed of electrically conductive material, at least one vertical stabilizer assembly including a fourth structural member formed of electrically conductive material, wherein the wing assembly, the horizontal stabilizer, and the vertical stabilizer are each interconnected with the fuselage assembly in a flight configuration substantially normal to said fuselage, wherein the first, second, third and fourth structural members are electrically insulated from one another and from the fuselage. Furthermore, an electronic communication device is disposed within the aircraft and is configurable for selective electrical interconnection of one of the structural members with at least one other of the structural members to form a transmitting/receiving antenna or for selective electrical interconnection of one of the structural members with at least one other of the structural members while at least one of the rest of the structural members is electrically connected to one other structural member to form a transmitting/receiving antenna.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which:

FIG. 0.1, is perspective view of a typical airframe showing fuselage, wings, horizontal stabilizers, vertical stabilizer, canards, and winglets, each of which can be used to form dipole antennas, monopole antennas and arrays of them by selectively electrically isolating some and interconnecting the rest;

FIG. 2, is a table of the electrical topography of differing antenna embodiments of the present invention including a wing dipole antenna, a horizontal stabilizer dipole antenna, a vertical stabilizer monopole antenna, a vertical stabilizer monopole antenna array, a fuselage monopole antenna employing aircraft wings, and a fuselage monopole antenna employing aircraft horizontal stabilizers;

FIGS. 5A1 and 5A2, show the variation of the measured maximum gain and Voltage Standing Wave Ratio (VSWR) of an example wing dipole antenna with the frequency realized using a medium size Unmanned Aerial Vehicle (UAV) made of carbon-fiber airframe;

FIGS. 5B1 and 5B2, show the same data as FIGS. 5A1 and 5A2 but for an example fuselage-wing monopole antenna realized using the same UAV;

FIGS. 6A1 and 6A2, show the measured Horizontal Polarization (H-Pol) and Vertical Polarization (V-Pol) gain patterns of the antenna of FIGS. 5A1 and 5A2 at 90 MHz;

FIGS. 6B1 and 6B2, show the measured H-Pol and V-Pol gain patterns of the antenna of FIGS. 5B1 and 5B2 at 90 MHz;

Figure 1A:
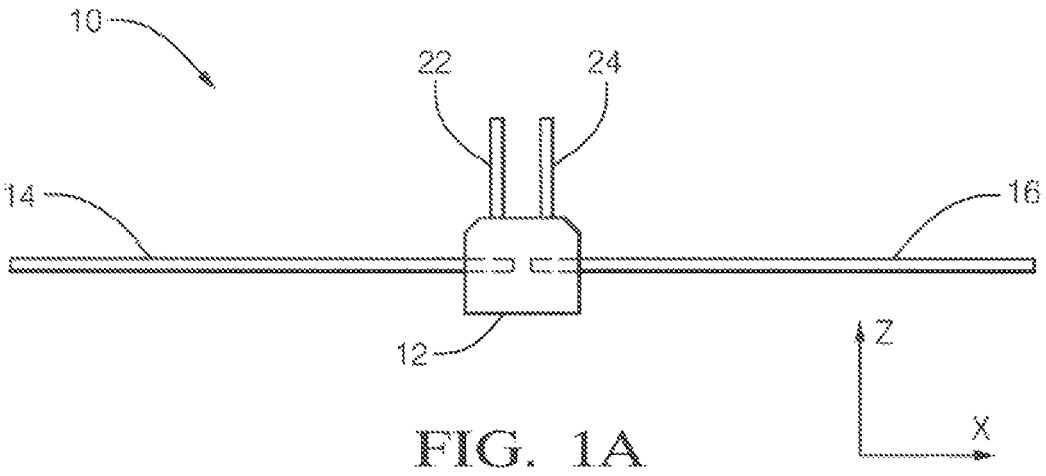
FIG. 1A, is a schematic front plan view of a typical aircraft airframe employed to form integral dipole and monopole antennas.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENTS

The varied embodiments of the present invention disclosed herein add zero or de minimis additional weight to the host aircraft, is invisible, requires minimal wiring and forms extremely high efficiency antennas (often times, achieving the theoretical limit).

The present invention comprises an apparatus and method for isolating and combining select electrically conductive sections of an airframe to form dipole and monopole antenna structures capable of varied polarization directionality. Without loss of generality, in referring to FIGS. 1A and 1B, the inventive method is alternatively implemented by wiring the wings or the horizontal stabilizers as dipoles, the wing-fuselage, the horizontal stabilizer-fuselage or, the vertical stabilizer-fuselage combination as a monopole, and, in the case of aircraft with two vertical stabilizers, the two vertical stabilizer-fuselage combinations as the two-element monopole array.

When operated at the natural resonance frequencies (when the length of the structure forming the antenna is about half or quarter wavelengths for dipoles or monopoles, respectively), the antennas will have near perfect radiation efficiencies depending on the conductivity of the airframe. Each arrangement is illustrated in terms of electrical topography in FIG. 2. In practice, aluminum, steel, carbon-fiber or any other electrically conducting airframes can produce antennas with near perfect efficiencies. Efficiencies will increase as the frequency decreases so, in practice, for example, near perfect efficiencies were recorded with carbon-fiber airframes in HF, VHF and UHF bands depending on the dimensions of the airframe parts. Alternatively, with the help of antenna tuning circuitry, such antenna rearrangements can be operated at frequencies different than their natural resonance frequencies at efficiencies much higher than any other conformal airborne antenna technology.

The present invention realizes conformal airborne antennas with near perfect radiation efficiencies, require minimal cost to implement, add zero weight to the aircraft, cause no extra drag, are conspicuous by revealing no information about the frequency band of the antenna and pose no maintenance hazard. Competing solutions such as paint-on or recessed conformal antennas, which, while having minimal drag and weight, possess poor radiation efficiencies, are maintenance nightmare for aircraft maintenance crews which must take extreme caution when working over or around the airframe surfaces containing the antenna and are very costly to implement. Existing blade antennas cause significant drag, visually broadcast the frequency of operation (evident from the height), require significant modification to the airframe to implement and often offer poor efficiencies over VHF and lower bands as their heights must be limited. By "near perfect", the applicant means an airborne antenna with a radiation efficiency, which is within 2 db of that of an ideal dipole.

Referring to Drawing FIG. 0.1, a typical airframe 214 includes a fuselage 216, left and right main wings 218, left and right horizontal stabilizers 220, one or more vertical stabilizers 222, left and right canards 224, and left and right winglets 226, each of which can be used to form dipole antennas, monopole antennas and arrays of them by selectively electrically isolating some and interconnecting the rest. The aircraft's line of flight is depicted by arrow "Y". The horizontally extending wings 218, stabilizers 220 and canards 224 are depicted by arrow "X". The vertically extending stabilizer 222 is depicted by arrow "Z".

Figure 1B:
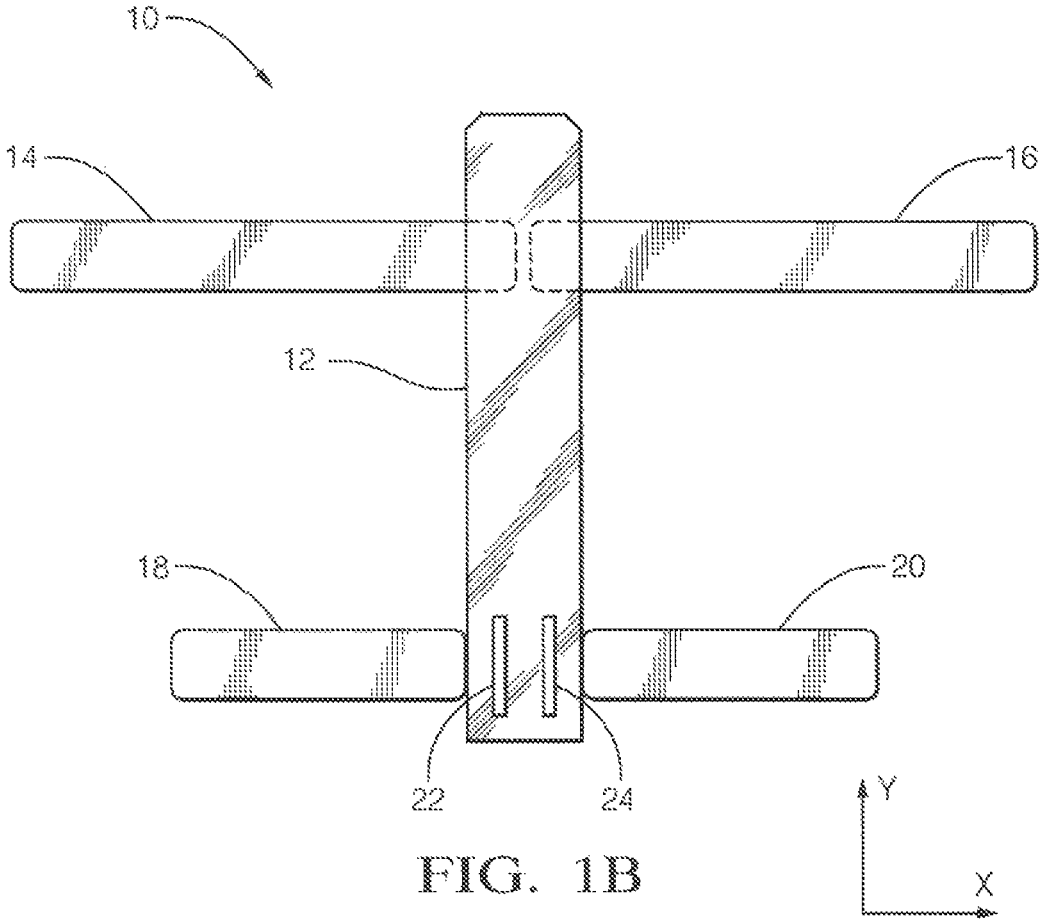
FIG. 1B, is a schematic top plan view of the typical aircraft airframe FIG. 1A.

Referring to the drawings, and particularly to FIG. 1A and 1B, views of one embodiment of the invention are illustrated in schematic, front and top plan views. An aircraft 10 comprises a fuselage assembly 12 which is elongated along the "Y" or longitudinal axis and which supports a plurality of airfoil assemblies including an opposed pair of main wings 14, 16, an opposed pair of tail wings or horizontal stabilizers 18, 20, and a spaced apart pair of vertical stabilizers 22, 24. The main wings 14, 16 and horizontal stabilizers 18, 20 are elongated along the "X" or lateral axis. The vertical stabilizers 22, 24 are laterally spaced apart and are elongated along the "Z" axis.

Various movable control surfaces (e.g., ailerons, elevators, tail planes, rudders, leading/trailing edge flaps, winglets, canards and airbrakes/spoiler) are typically integrated within aircraft airfoils to control aircraft attitude, pitch, yaw and roll in flight. The control surfaces themselves are typically controlled directly or indirectly mechanically/hydraulically by a pilot or by servo actuators. For the sake of simplicity, such known devices are not described in detail in the present application.

Referring to FIG. 2, the wiring topology of each antenna type is illustrated in stick figure form including an elongated structural member within each aircraft component assembly. Specifically, the conductive portion of the fuselage is illustrated as an elongated conductive structural member 26 extending along axis Y. The conductive portion of each main wing is illustrated as an elongated conductive structural member 28, 30 extending along axis X. The conductive portion of each horizontal stabilizer is illustrated as an elongated conductive structural member 32, 34 extending along axis X. The conductive portion of each vertical stabilizer is illustrated as an elongated conductive structural member 36, 38 extending along axis Z. Each of the conductive structural members 26-38 are structurally supported by the others in forming the associated aircraft, but are electrically isolated from one another. At least two of the structural members 26-38 form electrical connection points 40, 42 (40', 42') which are electrically interconnected to form a desired antenna configuration.

Figure 3:
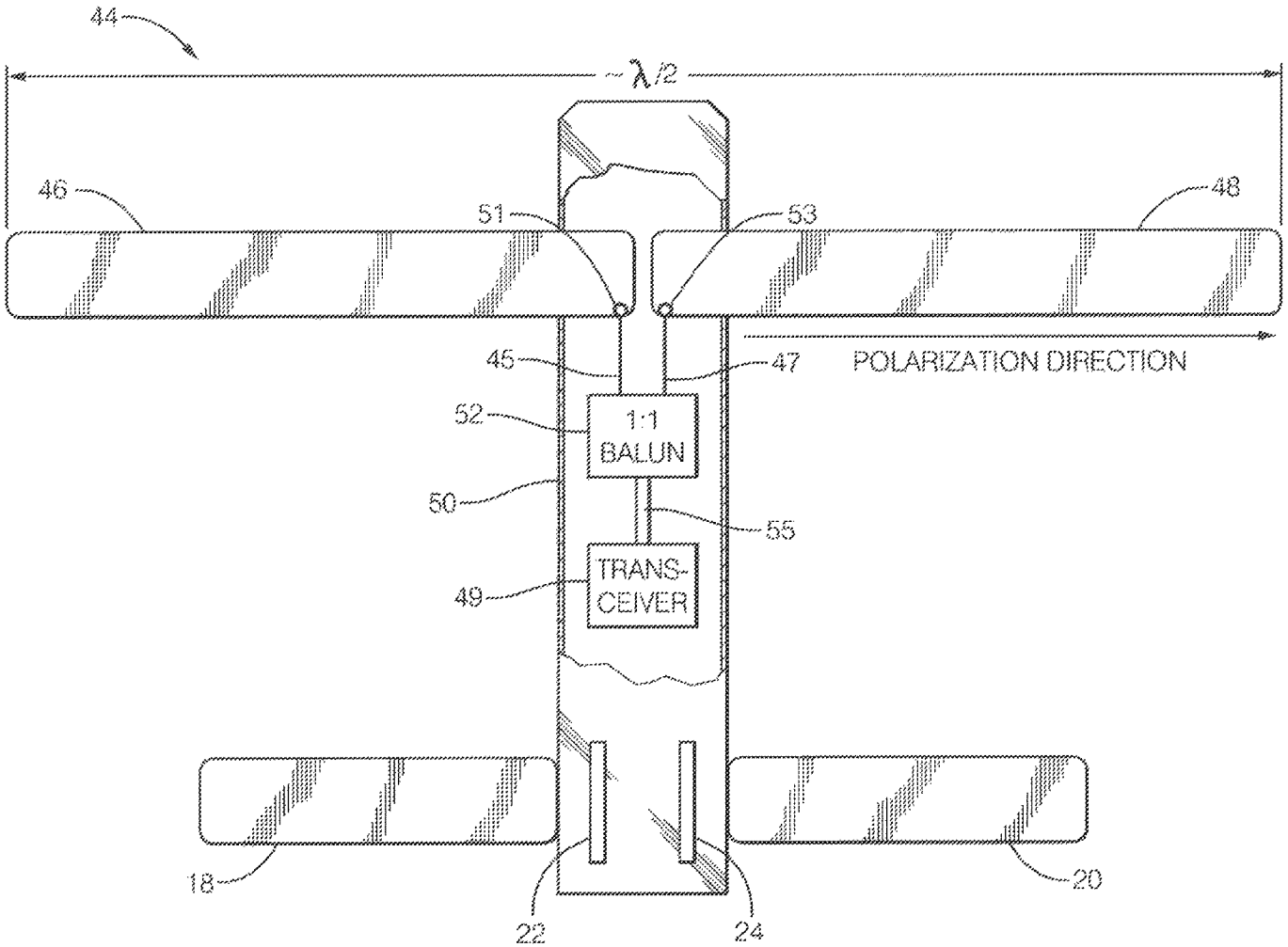
FIG. 3, is a top plan view of the aircraft airframe of FIGS. 1A and 1B configured as a wing dipole antenna.

Referring to FIG. 3, an aircraft 44 configured with a wing dipole antenna uses the front wings 46, 48 as two elements of a dipole antenna. The main wings 46, 48 are electrically isolated from the rest of the aircraft 44, including the fuselage 50, from the horizontal stabilizers 18, 20, the vertical stabilizers 22, 24, and from one another. The antenna is fed using a 1:1 balun 52 with each lead 45, 47 of the balun 52 connected to one of the main wings 46, 48 at attachment points 51, 53. The balun 52 is interconnected to a transceiver 49 (e.g.; transmitter, receiver or combination thereof) via an antenna feed coaxial cable 55. The combined lateral length of the main wings 46, 48 (~$\lambda/2$, where $\lambda$ is the wavelength) determines the primary resonance frequency of the antenna and corresponds to the combined length of the main wings 46, 48 equal to approximately ½ wave length at the frequency of operation.

Figure 4:
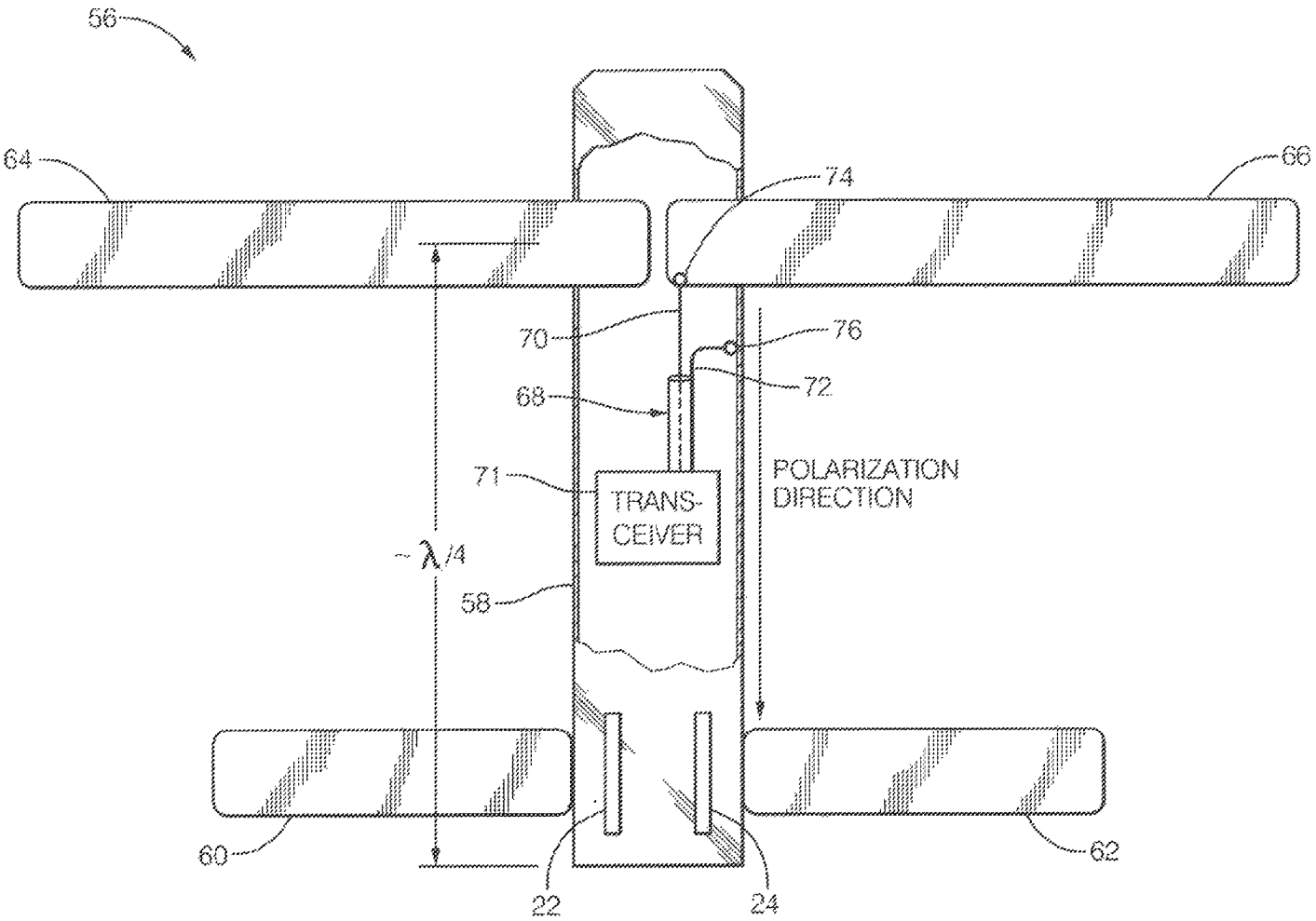
FIG. 4, is a top plan view of the aircraft airframe of FIGS. 1A and 1B configured as a fuselage monopole antenna.

Referring to FIG. 4, in an airplane 56, the fuselage monopole antenna configuration uses the fuselage 58 and horizontal stabilizers 60, 62 as a top-loaded monopole antenna. The front wings 64, 66 are electrically isolated from the rest of the aircraft 56. The fuselage 58 is the radiating element of the antenna and the front wing 66 serves as the ground plane. The horizontal stabilizers 60, 62 of the airplane 56 serve to add a capacitive or conductive load to the top of the antenna element depending on whether they are electrically isolated from or connected to the fuselage, respectively (both cases work). The antenna is fed by attaching the center conductor 70 of a coaxial antenna feed cable 68 extending from a transceiver 71 to one of the front wings 66 at an attachment point 74 and attaching the outer (ground) conductor 72 of the coaxial feed cable 68 to the fuselage 58 at another attachment point 76. Inner and outer conductors of the coaxial cable can be connected in reverse and reversing them does not make a difference in the operation of the antenna. The polarization direction of the antenna extends primarily longitudinally along the fuselage 58 though the polarization purity is not as high as the wing dipole described in FIG. 3. The resonance frequency of the antenna depends on the longitudinal length of the fuselage 58 and the rear wing structure 60, 62, which is close to quarter of a wavelength (~$\lambda/4$).

Referring to FIGS. 3 and 4, the two antenna options, when implemented on a particular UAV, have been observed, in practice, to operate over similar frequency bands with similar gain levels. FIGS. 5A and 5B show the measured variation of Gain and VSWR with frequency for wing dipole and fuselage-wing monopole antennas, respectively, which are implemented on a particular medium size UAV with carbon-fiber airframe. Both antennas are observed to operate in similar frequency bands, namely, 80-110 MHz. It must be noted that the maximum gains are also similar: 2 dBi for the wing dipole and 0.5 dBi for the fuselage-wing monopole. It is evident from this data that both dipole configuration exhibit near perfect radiation efficiency since gain of a perfect dipole is 2.2 dBi. Monopole gain suffers polarization impurity but is still within 1.5 dB of the dipole. FIGS. 6A2 and 6B2 show the H-pol and V-pol gain patterns at 90 MHz of the wing dipole and the fuselage-wing monopole antennas, respectively. The gain patterns shown in FIGS. 6A2 and 6B2 are typical of dipole and monopole behavior, respectively, and validate the polarization directions depicted in FIGS. 3 and 4. Patterns also exhibit 10 dB or larger polarization isolation. The gain pattern of FIG. 6A2 is recorded by rotation of a test aircraft 228 about axis Y (referring to FIG. 1B) as indicated by arrow 230. Likewise, the gain pattern of FIG. 6B2 is recorded by rotation of a test aircraft 232 about axis Y (referring to FIG. 1B) as indicated by arrow 234.

Figure 7:
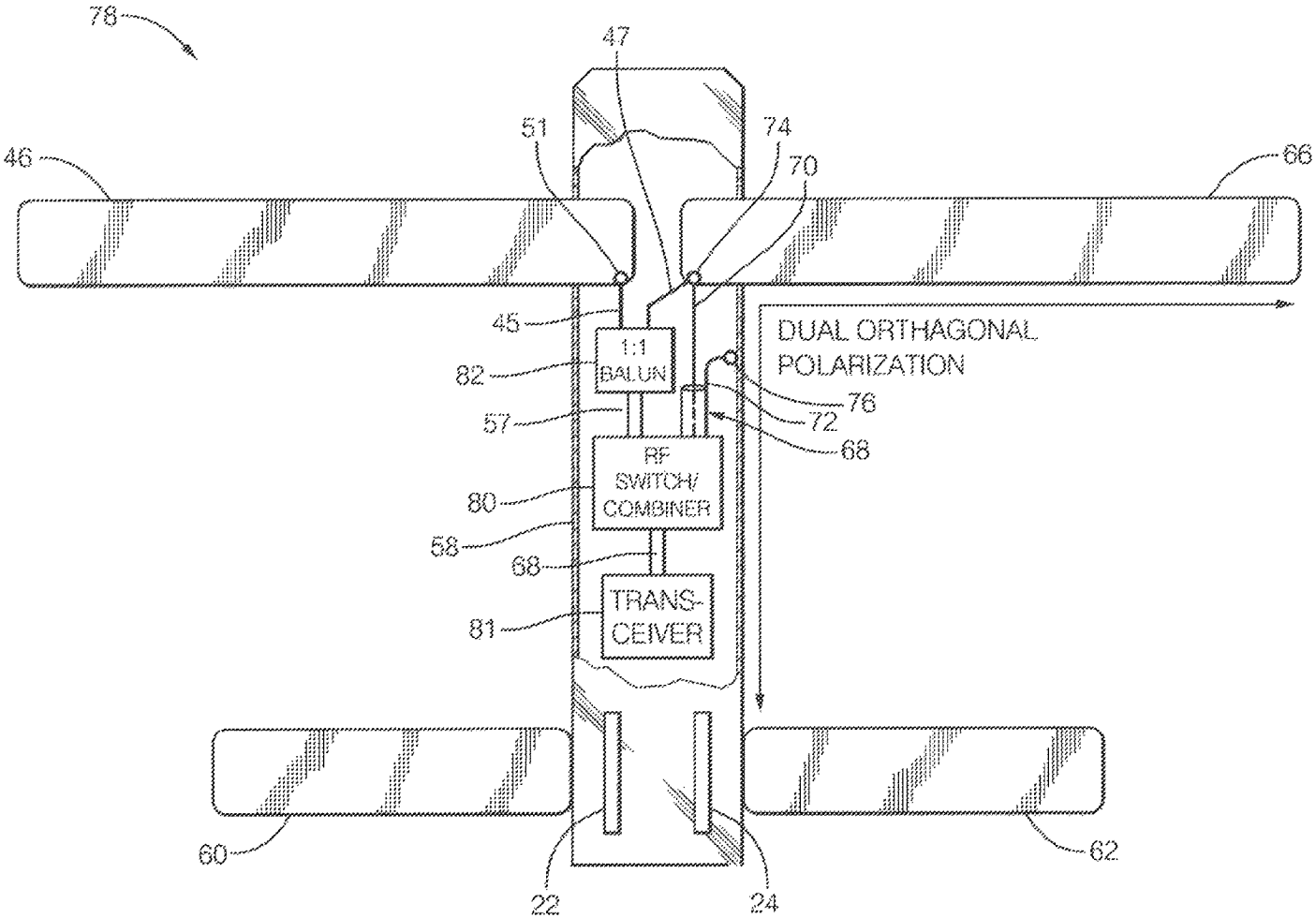
FIG. 7, is a top plan view of the aircraft airframe of FIGS. 1A and 1B configured as a dual orthogonal polarization antenna for polarization diversity applications supporting Multiple-In-Multiple-Out (MIMO) implementation.

Referring to FIGS. 3 and 4, by combining the two antenna options illustrated, an antenna with dual, orthogonal polarizations can be realized as shown in FIG. 7 in an aircraft 78. Switching between either the wing dipole or fuselage-wing monopole antenna configurations with the help of an RF switch 80 would allow for polarization diversity. Switching is accomplished by use of a coax switch/combiner 80 with an input from the coaxial antenna feed cable 68 from a transceiver 81. The coax switch/combiner 80 has two outputs, one feeding the input of a 1:1 balun 82 through a coaxial lead 57 and one feeding the main wing attachment point 74 of the main wing 66 attachment point 74 through the center conductor 70 of a coaxial lead 68. The outer conductor 72 of the coaxial lead 68 is connected to a ground connection point 76 of the fuselage 58. The 1:1 balun 82 has a first output interconnected to the main wing attachment point 51 of the port main wing 46 through a lead 45, and a second output interconnected to the main wing attachment point 74 of the starboard main wing 66 through a lead 47. Considering also the data presented in FIGS. 5A, 5B, 6A and 6B, the dual polarization antenna of FIG. 7 can be used effectively to implement polarization diversity or MIMO to double wireless channel capacity since both antennas operate over the same frequency bands, have similar gain levels and possess 10 dB or more polarization isolation.

Figure 8:
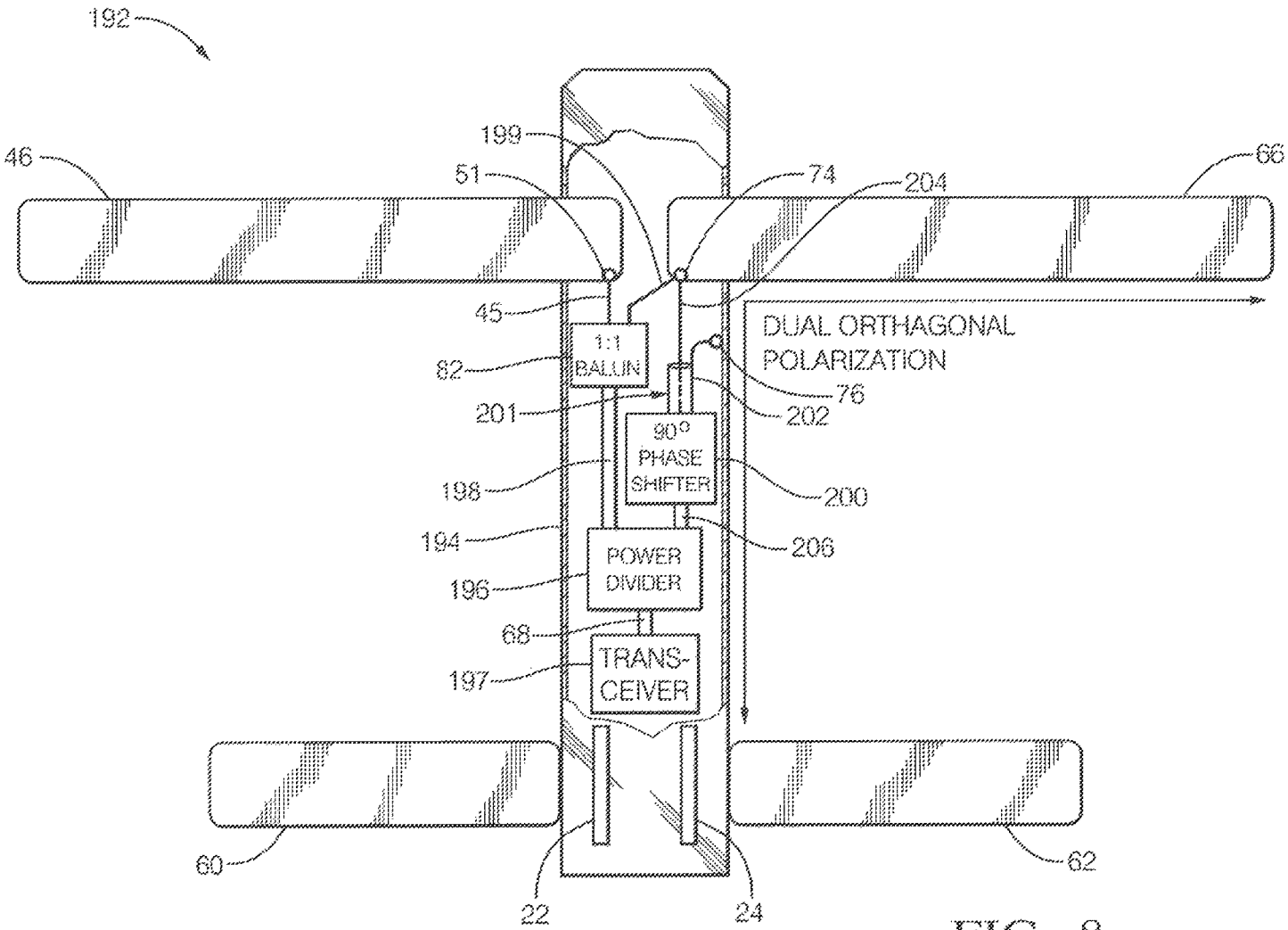
FIG. 8, is a top plan view of the aircraft airframe of FIGS. 1A and 1B configured as a circular polarization antenna variant to that embodied in FIG. 7.

Referring to FIG. 8, an aircraft 192, by combining the two antenna options illustrated in FIGS. 3 and 4, provides a circularly-polarized antenna. The only differences from FIG. 7 are that the RF switch 80 is replaced by a power divider 196 and the monopole antenna feed now contains a 90 degree phase shifter (realized by a section of a coax or a lumped passive circuit) 200. The power divider 80 has two outputs, one feeding the input of a 1:1 balun 82 through a coaxial lead 198 and one feeding the input of a 90° phase shifter 200. One output of the 1:1 balun 82 is interconnected with an attachment port 51 of one wing 46 by a lead 45. A second output of the 1:1 balun 82 is interconnected with an attachment port 74 of the other main wing 66 by a lead 199. The output of the 90° phase shifter 200 is interconnected with main wing attachment point 74 of the main wing 66, through the center conductor 204 of a coaxial lead 201. The outer conductor 202 of the coaxial lead 201 is connected to a ground connection point 76 of the fuselage 194. Both sections of the main wing 46 and 46 are otherwise electrically isolated from each other and from the fuselage. Circularly polarized antennas have been shown to be effective in improving wireless link quality in environments that experience polarization reversal or polarization rotation, urban areas, non-line-of-sight scenarios, environments with a lot of foliage and obstacles, and any communication that involves reflections from and propagation through the ionosphere. In addition, all satellite-based communications require circularly polarized antennas including GPS, Satellite Radio and TV, and many military communications due to polarization rotation caused by ionosphere.

Figure 9:
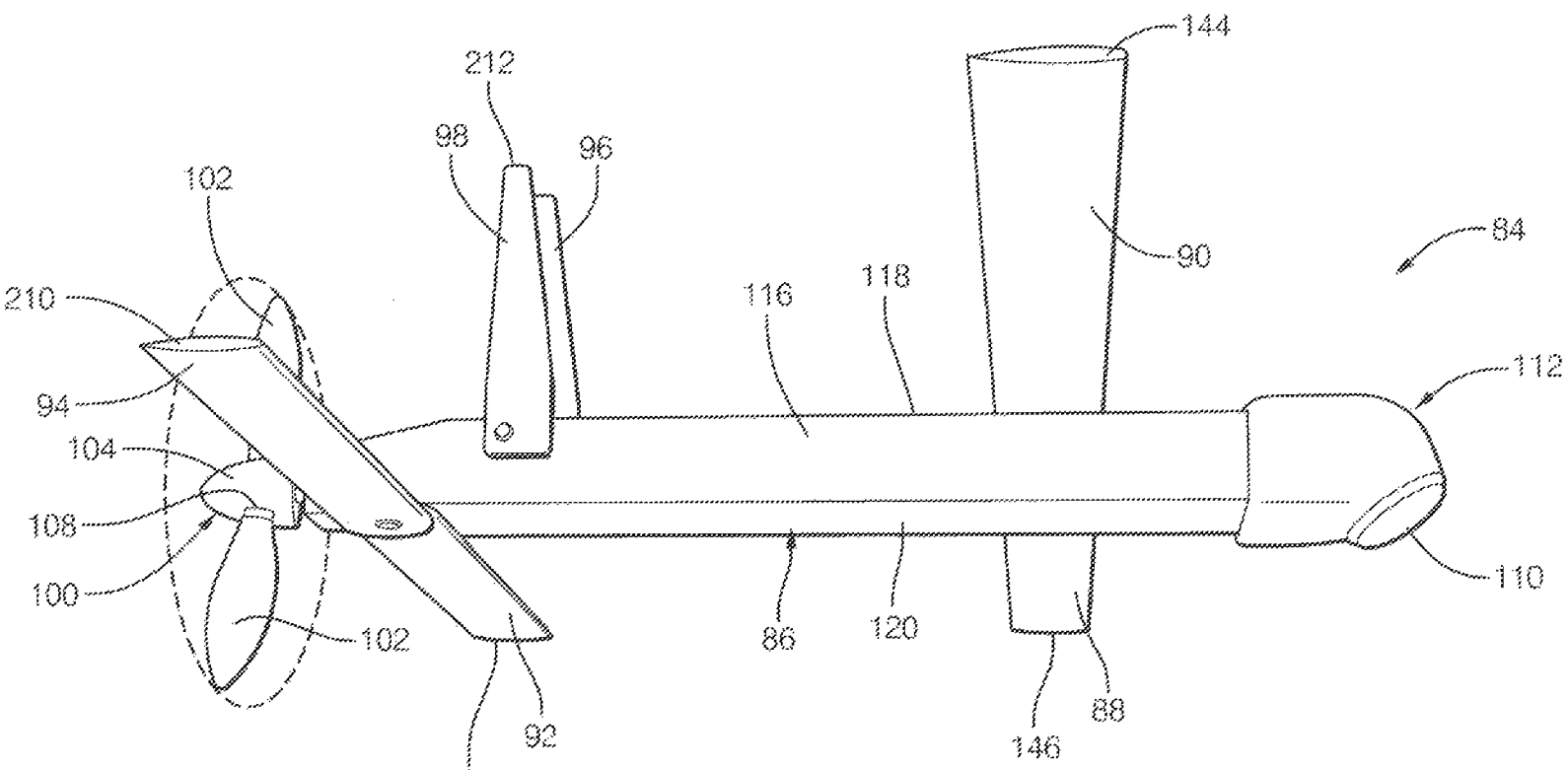
FIG. 9, is a perspective view of one embodiment of the present invention with all aircraft airfoils (wings, vertical stabilizers, and horizontal stabilizers) and propeller in a flight deployed orientation.
Figure 10:
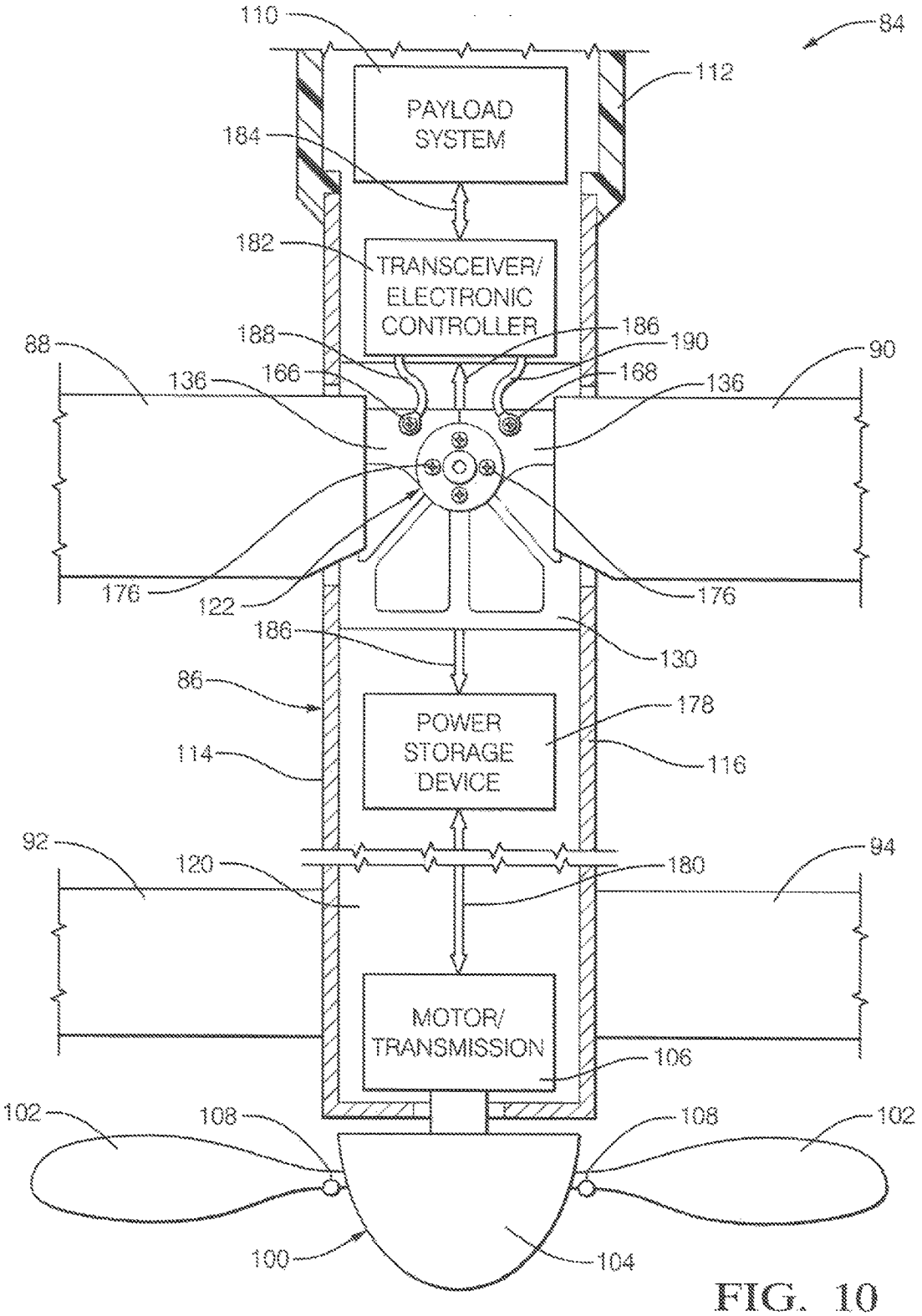
FIG. 10, is a broken, cross-sectional view of the present invention of FIG. 9 illustrating the major internal components and subsystems of the aircraft.

Referring to FIGS. 9 and 10, an embodiment of the present invention can be implemented in a pilotless drone-type aircraft (i.e. a UAV) 84 comprising an elongated fuselage 86, an opposed pair of front wings 88, 90, an opposed pair of horizontal stabilizers 92, 94, and an opposed pair of vertical stabilizers 96, 98, collectively referred to as airfoil assemblies. The airfoil assemblies are attached to the fuselage 86 for in-flight positions illustrated in FIGS. 9 and 10. The aircraft 84 further includes a "pusher" propeller system 100 within its empennage including a plurality of blades 102 and a rotating hub 104 driven by a motor/transmission system 106. The blades 102 are interconnected to the hub 104 by hinges 108. The aircraft 84 further includes a front payload system 110 suitable for navigation, surveillance and the like, disposed within a nose cone 112.

Each airfoil assembly (e.g., front wings 88, 90, horizontal stabilizers 92, 94, and vertical stabilizers 96, 98) is pivotally mechanically affixed to the fuselage 86. Furthermore, each airfoil assembly (e.g., front wings 88, 90, horizontal stabilizers 92, 94, and vertical stabilizers 96, 98) is electrically isolated from one another as well as the fuselage 86 to enable selective coupling in varying combinations to effect varied antenna configurations.

In the embodiment of FIGS. 9 and 10, the fuselage 86 is formed of rectangular aluminum (e.g., electrically conductive) structure including left (port), right (starboard), top and bottom integrated side members 114, 116, 118 and 120, respectively. Thus, the fuselage 86 can be employed in its entirety as an elongated structural member as an element of the antenna. Similarly, each airfoil assembly is formed of an elongated aluminum spar (i.e., electrically conductive) covered with an aerodynamically shaped (carbon-fiber composite) skin (i.e., electrically conductive). Thus, each airfoil assembly (wings 88, 90 and stabilizers 92, 94, 96 and 98) can be employed in its entirety as an elongated structural member as a second element of the antenna. Because the fuselage 86 and airfoil assemblies (wings 88, 90 and stabilizers 92, 94, 96 and 98) collectively form the entire airframe, no net weight is added to the aircraft 84 to integrate the antenna and hence, the "zero-weight assertion.

Attachment of each airfoil to the fuselage 86 is accomplished by an electrically insulting pivot assembly 122 employing a pivot shaft, a top cap and a number of washers and shims, all of which are made of non-conductive materials.

Each front wing 88, 90 consists of elongated electrically conductive (metal) spar 136 interference fit within a through passage formed by an aerodynamically shaped conductive (carbon-fiber composite) skin. The spars transition into a pair of concentric annular bushings containing antenna wire connection points 166 and 168.

Thus assembled, the pivot assembly 122 serves to mechanically support the wings 88, 90 to the fuselage, while simultaneously continuously electrically insulating the wings 88, 90 from one another and the fuselage 86. As illustrated in FIG. 10, the pivot assembly 122 is suitably affixed to the fuselage 86, such as with threaded fasteners 176 while preserving the above-stated electrical isolation. Finally, electrically insulating latches (not illustrated) are provided to maintain the airfoil assemblies in their respective flight positions of FIG. 9. Referring to FIGS. 9 and 10, the outward most end tips of each airfoil 88, 90, 92, 94, 96 and 98 are closed by an end cap formed of electrically conductive carbon-fiber composite material. The main wings 88 and 90 include end caps 144 and 146, respectively. The horizontal stabilizers 92 and 94 include end caps 208 and 210, respectively. The vertical stabilizers 96 and 98 include end caps 212 (only one illustrated). The end tips serve to provide a tip end shape for each airfoil, as well as providing water-tight hermetic sealing of each respective airfoil.

Referring to FIG. 10, a propulsion system is disposed within the fuselage 86, including electric motor/transmission assembly 106 powered by a power storage device 178 (e.g., battery) to drive the propeller system 100 via electrical cables 180. Furthermore, a reconnaissance/communication/control system is disposed within the fuselage 86, including an electronic controller/computer 182 including a microprocessor and memory. The controller 182 is interconnected with the aircraft payload system 110 by cables 184 and with the power storage device 178 by cables 186. The transceiver (transmitter/receiver) portion of the controller 182 is interconnected with each airfoil assembly and/or fuselage 86 forming a portion of the aircraft antenna system by flexible wires 188, 190 through wire connector ports 166, 168. It must be noted that the particular connections between the transceiver 182 and the front wings through the wires 188, 190 described above depict specifically the realization of the wing-dipole arrangement of FIG. 3 and is provided here as an example of how the wiring is accomplished. Similar wiring is carried out to realize the other antenna arrangements described in this invention.

The results and advantages of the present invention consists of:

- Conformal and zero-weight antennas. Antenna integration does not change aerodynamics or significantly affect the structural integrity of the aircraft.
- Antenna with near-perfect radiation efficiency, very close to that of a half-wave dipole antenna at the same frequency of operation.
- Allows for antennas to be integrated into aircraft operating at significantly lower frequencies and significantly higher efficiencies than competing conformal solutions.
- Can provide antennas with orthogonal polarizations for polarization diversity and MIMO or for transmission and reception of circular polarization without loss of radiation efficiency for increasing wireless channel capacity.

The following documents are deemed to provide a fuller background disclosure of the inventions described herein and the manner of making and using same. Accordingly, each of the below-listed documents are hereby incorporated into the specification hereof by reference.

U.S. Pat. No. 2,510,698 to Johnson entitled "Radio Aerial, Particularly for Aircraft and Other Vehicles".

U.S. Pat. No. 3,365,721 to Bittner entitled "Current Discontinuity Device".

U.S. Pat. No. 3,587,102 to Czerwinski entitled "Helicopter Skid Antenna".

U.S. Pat. No. 3,564,134 to Rue entitled "Two-Camera Remote Drone Control".

U.S. Pat. No. 3,646,562 to Acker et al. entitled "Helical Coil to a Live Tree to Provide a Radiating Antenna".

U.S. Pat. No. 3,742,495 to Diamantides entitled "Drone Guidance System and Method".

U.S. Pat. No. 4,100,546 to Campbell et al. entitled "Airborne Antenna System Employing the Airframe as an Antenna".

U.S. Pat. No. 4,117,490 to Arnold et al. entitled "Inconspicuous Antenna System Employing the Airframe as an Antenna".

U.S. Pat. No. 5,231,409 to Astier et al. entitled "Microwave Antenna Capable of Operating at High Temperature, in Particular for a Space-Going Aircraft".

U.S. Pat. No. 6,119,976 to Rogers entitled "Shoulder Launched Unmanned Reconnaissance System".

U.S. Pat. No. 7,053,812 B2 to Trainor entitled "Recoverable Pod for Self-Protection of Aircraft Using a Recoverable Pod".

U.S. patent application Ser. No. 2008/0210818 A1 to Chiu et al. entitled "Autonomous Back-Packable Computer-Controlled Breakaway Unmanned Aerial Vehicle (UAV)".

U.S. Pat. No. 7,467,762 B1 to Parsons entitled "Advanced Unmanned Aerial Vehicle System", U.S. patent application Ser. No. 2009/0322147 A1 to Cooney entitled "Aircraft with Isolated Ground".

U.S. Pat. No. 8,115,145 B2 to Shariff et al. entitled "Systems and Methods for Base Station Enclosures".

U.S. Pat. No. 8,282,040 to Westman et al. entitled "Composite Aircraft Wing".

U.S. patent application Ser. No. 2015/0237569 A1 to Jalali entitled "Unmanned Aerial Vehicle Communication Using Distributed Antenna Placement and Beam Pointing".

U.S. Patent Application Publication No. 2005/0236778 A1 to Jalali entitled "Broadband Access to Mobile Platforms Using Drone/UAV Background".

U.S. Pat. No. 9,337,889 B1 to Stapleford entitled "Drone Aircraft Detector".

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basic constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. An aircraft comprising:

a fuselage assembly including a first elongated structural member formed of electrically conductive material;

at least one airfoil assembly consisting of an opposed pair of symmetrical sections including an opposed pair of second structural members formed of electrically conductive material;

at least a one second airfoil assembly including a third elongated structural member formed of electrically conductive material.

each said airfoil assembly interconnected directly or indirectly with said fuselage assembly in a flight configuration wherein said first and second structural members are electrically insulated from one another, said second airfoil assembly interconnected directly or indirectly with said fuselage assembly in a flight configuration wherein said first and third structural members are electrically insulated from one another; and an electronic communication device disposed within said aircraft and configurable for selective electrical interconnection of said opposed pair of second structural members to form a transmitting/receiving dipole antenna, and/or an electronic communication device disposed within said aircraft and configurable for selective electrical interconnection of either said first and second structural members or said first and third structural members to form a transmitting/receiving monopole antenna.

2. The aircraft of claim 1, wherein said aircraft comprises a UAV.

3. The aircraft of claim 1, where said airfoil comprises a concentric opposed pair of front wings including an aligned pair of said second structural members.

4. The aircraft of claim 3, wherein said electronic communication device is operable for selective electrical interconnection of said pair of second structural members to form a wing dipole antenna.

5. The aircraft of claim 3, wherein said electronic communication device is operable for selective electrical interconnection of said first structural member with one of said pair of second structural members to form a fuselage-wing monopole antenna.

6. The aircraft of claim 1, wherein said airfoil comprises a concentric opposed pair of horizontal stabilizers including an aligned pair of said second structural members.

7. The aircraft of claim 6, wherein said electronic communication device is operable for selective electrical interconnection of said pair of second structural members to form a horizontal stabilizer dipole antenna.

8. The aircraft of claim 6, wherein said electronic communication device is operable for selective electrical interconnection of said first structural member with one of said pair of second structural members to form a fuselage-horizontal stabilizer monopole antenna.

9. The aircraft of claim 1, wherein said airfoil comprises at least one vertical stabilizer including a third elongated structural member.

10. The aircraft of claim 9, wherein said electronic communication device is operable for selective electrical interconnection of said first structural member with said third structural member to form a vertical stabilizer monopole antenna.

11. The aircraft of claim 9, wherein said airfoil comprises a plurality of vertical stabilizers including third elongated structural members, and wherein said electronic communication device is operable for selective electrical interconnection of said first structural member with each said third structural member to form a vertical stabilizer monopole antenna array.

12. The aircraft of claim 1, wherein said airfoil and said first structural member are synonymous, consisting of an elongated core or spar and an aerodynamically shaped outer skin.

13. The aircraft of claim 12, wherein said outer skin is formed of carbon-fiber material.

14. The aircraft of claim 1, wherein said airfoil assembly comprises a swing wing affixed to said fuselage.

15. The aircraft of claim 3, wherein said airfoil assembly comprises a wingtip fence at the tip of the said wing.

16. The aircraft of claim 3, wherein said airfoil assembly comprises winglet extending up from the tip of said wing.

17. An aircraft comprising:

a fuselage assembly including an elongated structural member formed of electrically conductive material;

at least one wing assembly including a second structural member formed of electrically conductive material;

at least one horizontal stabilizer assembly including a third structural member formed of electrically conductive material;

at least one vertical stabilizer assembly including a fourth structural member formed of electrically conductive material, wherein said wing assembly, said horizontal stabilizer, and said vertical stabilizer are each interconnected with said fuselage assembly in a flight configuration substantially normal to said fuselage wherein said first, second, third and fourth structural members are electrically insulated from one another and from said fuselage; and an electronic communication device disposed within said aircraft and configurable for selective electrical interconnection of one of said structural members with at least one other of said structural members to form a transmitting/receiving antenna.

18. The aircraft of claim 17, wherein said electronic communication device is configurable for selective electrical interconnection of at least two of said structural members to form a wing dipole antenna, a vertical stabilizer monopole antenna, a horizontal stabilizer dipole antenna, a vertical stabilizer monopole array antenna, a fuselage monopole antenna including a wing, or a fuselage monopole antenna including a horizontal stabilizer.

19. A method of forming an aircraft comprising the steps of:

forming a fuselage assembly including a first elongated electrically conductive structural member;

forming at least one airfoil assembly consisting of opposed pair of symmetric sections including an opposed pair of second electrically conductive structural members;

forming at least one second airfoil assembly including a third electrically conductive structural member;

affixing said fuselage with said airfoil assembly and said second airfoil assembly in a flight configuration wherein said first, second and third structural members are electrically insulated from one another; and installing an electronic communication device disposed within said aircraft configured for selective electrical interconnection of either said first and second structural members to form a monopole, or of said first and third structural members to form still another monopole, or opposed pair of symmetric sections of said second structural members to form a dipole transmitting/receiving antenna.

* * * * *